US008716544B2

(12) United States Patent
Shecterle

(10) Patent No.: US 8,716,544 B2
(45) **Date of Patent: *May 6, 2014**

(54) PROCESS FOR ISOMERIZING A FEED STREAM INCLUDING ONE OR MORE C4-C6 HYDROCARBONS

(75) Inventor: David James Shecterle, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 233 days.

This patent is subject to a terminal disclaimer.

(21) Appl. No.: 13/005,959

(22) Filed: Jan. 13, 2011

(65) Prior Publication Data

US 2012/0184794 A1 Jul. 19, 2012

(51) Int. Cl.
*C07C 5/27* (2006.01)

(52) U.S. Cl.
USPC ..... 585/738; 585/734; 585/748; 585/751

(58) Field of Classification Search
USPC ..... 585/734–751, 664, 671, 802, 803
See application file for complete search history.

(56) References Cited

U.S. PATENT DOCUMENTS

| | | | | |
|---|---|---|---|---|
| 3,018,244 | A | 1/1962 | Stanford et al. | |
| 3,150,205 | A | 9/1964 | Krane et al. | |
| 3,718,710 | A | 2/1973 | Quisenberry | |
| 3,903,196 | A | 9/1975 | Kemp | |
| 4,804,803 | A | 2/1989 | Schmidt et al. | |
| 4,929,794 | A | 5/1990 | Schmidt et al. | |
| 5,026,950 | A | 6/1991 | Schmidt et al. | |
| 5,026,951 | A | 6/1991 | Schmidt et al. | |
| 5,043,525 | A | 8/1991 | Haizmann et al. | |
| 5,138,112 | A | 8/1992 | Gosling et al. | |
| 5,227,554 | A * | 7/1993 | Chou | 585/303 |
| 5,233,120 | A | 8/1993 | Minkkinen et al. | |
| 5,326,926 | A | 7/1994 | Rice | |
| 5,602,291 | A | 2/1997 | Minkkinen et al. | |
| 6,416,657 | B1 | 7/2002 | Fersing et al. | |
| 6,573,417 | B1 | 6/2003 | Rice | |
| 6,706,659 | B2 * | 3/2004 | Gillespie et al. | 502/217 |

(Continued)

OTHER PUBLICATIONS

U.S. Appl. No. 13/005,940, filed Jan. 13, 2011, entitled "Process for Isomerizing a Feed Stream Including One or More C4-C6 Hydrocarbons" by Shecterle.

Bour et al., "Penex Unit Isomerizes Pentane and Hexane", Oil and Gas International, Nov. 1970, vol. 10, No. 11, pp. 101, 103-104, 106, 109.

(Continued)

*Primary Examiner* — In Suk Bullock
*Assistant Examiner* — Candace R Chouinard
(74) *Attorney, Agent, or Firm* — Maryann Maas

(57) ABSTRACT

One exemplary embodiment can be a process for isomerizing a feed stream including one or more C4-C6 hydrocarbons. Generally, the process includes contacting the feed stream in an isomerization reaction zone with an isomerization catalyst at isomerization conditions to produce an isomerization zone effluent; passing at least a portion of the isomerization zone effluent to a stabilizer zone and recovering a stabilizer overhead stream, a bottom stream, and a side-stream; passing at least a portion of the side-stream to a stripper zone; and sending a stripper bottom stream to a C5 splitter zone and passing a stream from the C5 splitter zone to the isomerization reaction zone. Generally, the stabilizer overhead stream can include one or more $C5^-$ hydrocarbons, a bottom stream can include at least about 85%, by weight, one or more $C6^+$ hydrocarbons, and a side-stream can include at least about 85%, by weight, one or more $C5^+$ hydrocarbons. Also, the stripper bottom stream can include at least about 90%, by weight, one or more $C5^+$ hydrocarbons.

19 Claims, 1 Drawing Sheet

(56) References Cited

U.S. PATENT DOCUMENTS

| | | | | |
|---|---|---|---|---|
| 6,759,563 | B1 | 7/2004 | Hibbs | |
| 7,022,889 | B2 * | 4/2006 | Gillespie et al. | 585/750 |
| 7,223,898 | B2 | 5/2007 | Rice | |
| 7,485,768 | B1 * | 2/2009 | Rice et al. | 585/734 |
| 7,514,590 | B1 | 4/2009 | Rice | |
| 7,902,412 | B2 * | 3/2011 | Senetar et al. | 585/331 |
| 2004/0249230 | A1 * | 12/2004 | Gillespie et al. | 585/750 |
| 2006/0205990 | A1 | 9/2006 | Rice | |
| 2008/0242904 | A1 | 10/2008 | Rice et al. | |
| 2008/0287724 | A1 * | 11/2008 | Shecterle | 585/735 |
| 2009/0069618 | A1 | 3/2009 | Rice | |
| 2009/0247805 | A1 | 10/2009 | Bournay et al. | |
| 2010/0145118 | A1 * | 6/2010 | Zimmerman et al. | 585/258 |

OTHER PUBLICATIONS

Cusher, "UOP Par-Isom Process", Handbook of Petroleum Refining Processes, 2003, Volume Third Edition, pp. 9.41-9.45.

Cusher, "UOP Penex Process", Handbook of Petroleum Refining Processes, 2003, Volume Third Edition, pp. 9.15-9.27.

Kesler, "Refinery Model Helps Save Energy", Hydrocarbon Processing, Jul. 1979, vol. 58, No. 7, pp. 156-158.

Laplante, "Economics of Combining n-Paraffin Separation with Isomerization and Distillation for Various Stocks in the C5/C6 Range", National Petroleum Refiners Association 1971 Annual Meeting Paper, Mar. 1971, 17 pages.

Pujado, "UOP Pacol Dehydrogenation Process", Handbook of Petroleum Refining Processes, 2003, Volume Third Edition, pp. 5.11-5.19.

* cited by examiner

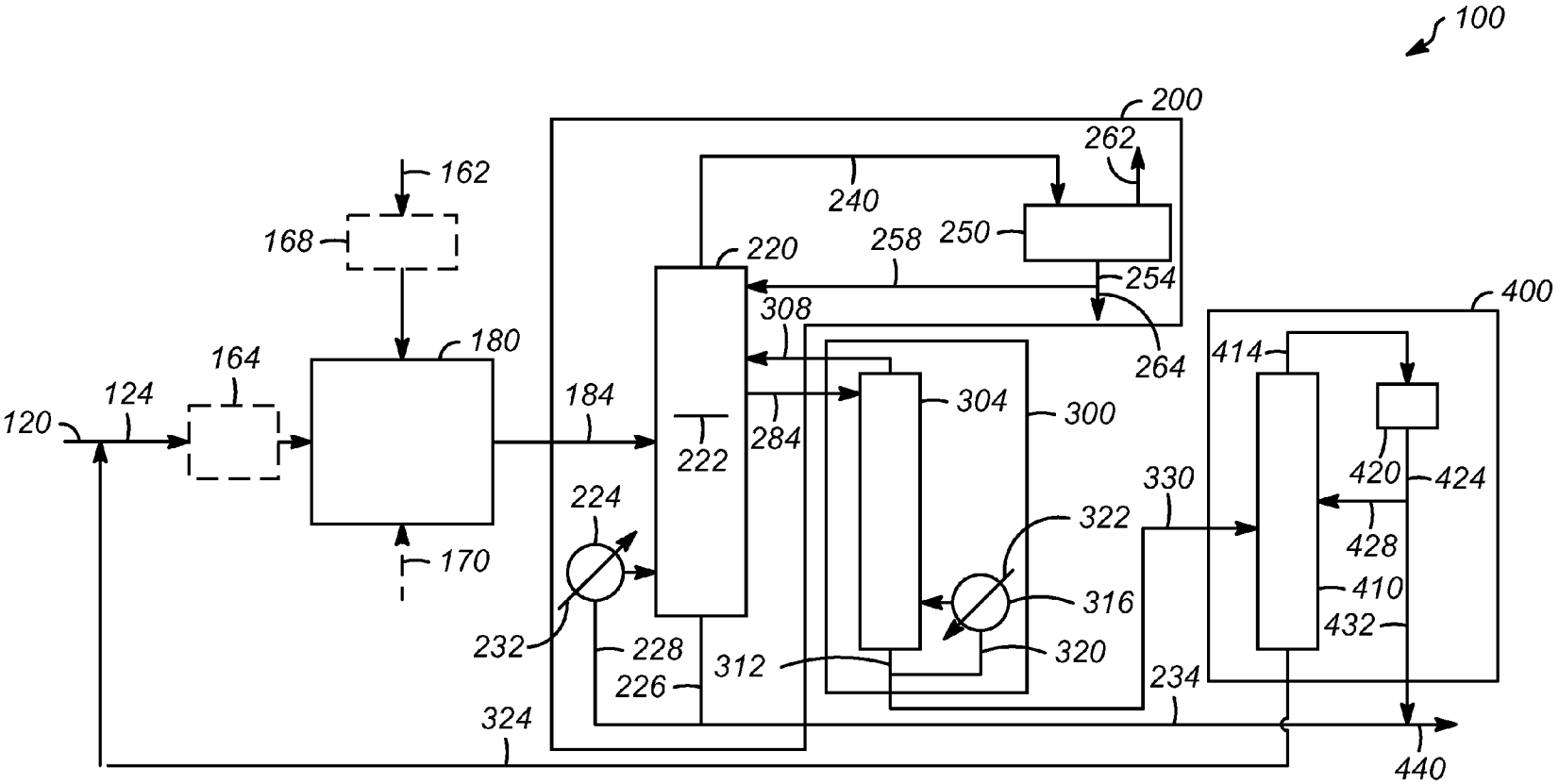
100
400
424
420
428
410
432
440
414
200
262
254
264
330
234
300
322
316
320
250
304
258
240
308
284
220
222
312
228
226
184
224
232
324
162
180
170
168
164
124
120

PROCESS FOR ISOMERIZING A FEED STREAM INCLUDING ONE OR MORE C4-C6 HYDROCARBONS

FIELD OF THE INVENTION

This invention generally relates to a process for isomerizing, and more particularly, a process for isomerizing a feed stream including one or more C4-C6 hydrocarbons.

DESCRIPTION OF THE RELATED ART

Normally, a traditional gasoline blending pool includes $C4^+$ hydrocarbons having boiling points of less than about 205° C. at atmospheric pressure. This range of hydrocarbons may include C4-C6 paraffins and, particularly C5-C6 normal paraffins that can have relatively low octane numbers. To improve octane, isomerization may rearrange the structure of the paraffinic hydrocarbons into branched-chain paraffins. Often, octane upgrading commonly uses isomerization to convert C6 and lighter boiling hydrocarbons.

Typically, isomerization units for C5 and C6 hydrocarbons may have a high C5 content that may limit octane, particularly if the equilibrium C5 isomerization ratio is reached in the reactor. Usually, a deisopentanizer column can be positioned in front of the isomerization unit to remove isomerized C5 hydrocarbons in the fresh feed allowing a higher conversion of the normal C5 hydrocarbons-rich isomerization reactor feed. However, the fresh feed normal pentane conversion to isopentane may be limited without recycling isomerized C5 hydrocarbons from the product. Utilization of sieves on the product can remove the normal pentane and permit their recycle, however such installations are generally capital intensive and require significant utilities. As a consequence, there is generally a desire to provide a mechanism that is less capital intensive and lowers utility utilization to permit the recycling of these materials.

SUMMARY OF THE INVENTION

One exemplary embodiment can be a process for isomerizing a feed stream including one or more C4-C6 hydrocarbons. Generally, the process includes contacting the feed stream in an isomerization reaction zone with an isomerization catalyst at isomerization conditions to produce an isomerization zone effluent; passing at least a portion of the isomerization zone effluent to a stabilizer zone and recovering a stabilizer overhead stream, a bottom stream, and a side-stream; passing at least a portion of the side-stream to a stripper zone; and sending a stripper bottom stream to a C5 splitter zone and passing a stream from the C5 splitter zone to the isomerization reaction zone. Generally, the stabilizer overhead stream can include one or more $C5^-$ hydrocarbons, a bottom stream can include at least about 85%, by weight, one or more $C6^+$ hydrocarbons, and a side-stream can include at least about 85%, by weight, one or more $C5^+$ hydrocarbons. Also, the stripper bottom stream can include at least about 90%, by weight, one or more $C5^+$ hydrocarbons.

Another exemplary embodiment may be a process for isomerizing a feed stream including one or more C4-C6 hydrocarbons. Usually, the process includes contacting the feed stream in an isomerization reaction zone with an isomerization catalyst at isomerization conditions to produce an isomerization zone effluent; passing at least a portion of the isomerization zone effluent to a stabilizer column and recovering a stabilizer overhead stream, a bottom stream, and a side-stream; passing at least a portion of the side-stream to a stripper column; sending a stripper bottom stream to a C5 splitter column to obtain an overhead stream and a bottom stream; and combining the C5 splitter column overhead stream with the stabilizer bottom stream as an isomerate product stream and recycling the C5 splitter column bottom stream to the isomerization reaction zone. Generally, the stabilizer overhead stream can include one or more $C5^-$ hydrocarbons, a bottom stream can include at least about 85%, by weight, one or more $C6^+$ hydrocarbons, and a side-stream can include at least about 85%, by weight, one or more $C5^+$ hydrocarbons. Also, the stripper bottom stream typically includes at least about 90%, by weight, one or more $C5^+$ hydrocarbons.

A further exemplary embodiment may be a process for isomerizing a feed stream including one or more C4-C6 hydrocarbons. The process can include contacting the feed stream in an isomerization reaction zone with an isomerization catalyst at isomerization conditions to produce an isomerization zone effluent; passing at least a portion of the isomerization zone effluent to a stabilizer column and recovering a stabilizer overhead stream, a bottom stream, and a side-stream; passing at least a portion of the side-stream to a stripper column; and sending a stripper bottom stream to a C5 splitter column to obtain an overhead stream and a bottom stream; and combining the C5 splitter column overhead stream with the stabilizer bottom stream as an isomerate product stream and recycling the C5 splitter column bottom stream to the isomerization reaction zone. Generally, the stabilizer overhead stream includes one or more $C5^-$ hydrocarbons, the bottom stream includes one or more $C6^+$ hydrocarbons, and a side-stream includes one or more $C5^+$ hydrocarbons. Also, the stripper bottom stream may include one or more $C5^+$ hydrocarbons.

Generally, the embodiments disclosed herein can allow the addition of a stripping zone to separate an isomerization zone effluent into separate streams. Particularly, a stripper overhead stream can include at least about 5%, by weight, of one or more $C4^-$ hydrocarbons and a stripper bottom stream comprising at least about 90%, by weight, of one or more $C5^+$ hydrocarbons. The stripper bottom stream can be recycled to a C5 splitter zone that can further separate isopentanes from normal pentanes. As a consequence, such a configuration can allow the efficient recycling of normal paraffinic C5 hydrocarbons, while minimizing the recycling of $C4^-$ hydrocarbons. Thus, the embodiments as disclosed herein can provide an improved process for recycling one or more C5 hydrocarbons in an isomerization zone without having an undue increase in energy and capital expenses.

Definitions

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^+$ or $C3^-$, which is inclusive of the abbreviated one or more hydrocarbons. As an example, the abbreviation "$C3^+$ " means one or more hydrocarbon molecules of three carbon atoms and/or more.

As used herein, the term "zone" can refer to an area including one or more equipment items and/or one or more subzones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of at least generally about 50%, and preferably about 70%, by mole, of a compound or class of compounds in a stream.

As used herein, the term "substantially" can mean an amount of at least generally about 80%, and preferably about 90%, by mole, of a compound or class of compounds in a stream.

As used herein, the terms "alkane" and "paraffin" may be used interchangeably.

As used herein, the term "overhead stream" can mean a stream withdrawn at or near a top of a column, typically a distillation column.

As used herein, the term "bottom stream" can mean a stream withdrawn at or near a bottom of a column, typically a distillation column.

As depicted, process flow lines in the figures can be referred to, interchangeably, as, e.g., lines, pipes, streams, feeds, effluents, and products.

BRIEF DESCRIPTION OF THE DRAWING

FIG. 1 is a schematic depiction of an exemplary isomerate manufacturing zone.

DETAILED DESCRIPTION

Referring to FIG. 1, an exemplary isomerate manufacturing zone 100 can include an isomerization reaction zone 180, a stabilizer zone 200, a stripping zone 300, and a C5 splitter zone 400. Zones for isomerizing C4-C6 hydrocarbons are disclosed in, e.g., Nelson A. Cusher, *UOP Penex Process and UOP Par-Isom Process*, The Handbook of Petroleum Refining Processes, 3rd edition, Robert A. Myers, editor, 2004, pp. 9.15-9.27 and pp. 9.41-9.45, as well as, e.g., U.S. Pat. Nos. 5,326,926, 7,223,898 B2, and 7,514,590 B1.

A feed stream 120 can include a hydrocarbon fraction having one or more C4-C6 normal paraffins. Such hydrocarbon fractions are disclosed in, e.g., U.S. Pat. No. 7,223,898 B2. The hydrocarbon fractions can include C4-C6 normal paraffins, and optionally rich in C4-C6 normal paraffins. One exemplary hydrocarbon fraction has substantially pure normal paraffins having from 4-6 carbon atoms. Other hydrocarbon fractions may include a light natural gasoline, a light straight run naphtha, a gas oil condensate, a light raffinate, a light reformate, a light hydrocarbon, a field butane, and a straight-run distillate having distillation end points of about 77° C. and optionally containing substantial quantities of one or more C4-C6 paraffins. The feed stream 120 may also contain low concentrations of unsaturated hydrocarbons and hydrocarbons having more than 6 carbon atoms.

In one exemplary embodiment, the feed stream 120 can include:

TABLE 1

(in percent, by weight)

| RANGE | $C4^-$ | C5 | C6 | $C7^+$ |
|---|---|---|---|---|
| General | 0-2 | 10-90 | 10-90 | 0-15 |
| Typical | 0.5 | 40-60 | 40-60 | 2 |

The feed stream 120 can be combined with a recycle stream 324, as hereinafter described, to form a combined feed 124, and its composition may vary among chemical manufacturing plants and refineries. The combined feed 124 can be provided to the isomerization reaction zone 180.

If a halided, such as a chlorided, catalyst is utilized, the combined feed 124 can pass through a dryer 164 before entering the isomerization reaction zone 180. Typically, the isomerization reaction zone 180 can also receive a makeup-gas stream 162 that may pass through a dryer 168 and a chloride stream 170. An exemplary isomerization reaction zone 180 is disclosed in, e.g., U.S. Pat. No. 7,223,898. In such an isomerization reaction zone 180, the gas often separated in the stabilizer zone 200, as hereinafter described, can be scrubbed prior to being discharged.

The isomerization reaction zone 180 can include one or more exemplary catalysts disclosed in, e.g., U.S. Pat. Nos. 7,223,898 B2 and 5,326,926. The combined feed 124 may be contacted in the isomerization reaction zone 180 with an isomerization catalyst. Such a catalyst can be a halided catalyst, such as a chlorided platinum alumina catalyst. The alumina can be an anhydrous gamma-alumina, although other aluminas may be utilized. In addition to platinum, the catalyst may optionally include one or more of palladium, germanium, ruthenium, rhodium, osmium, and iridium. The catalyst may contain from about 0.1-about 0.25%, by weight, platinum, and optionally about 0.1-about 0.25%, by weight, one or more of palladium, germanium, ruthenium, rhodium, osmium, and iridium, based on the weight of the catalyst. Such an exemplary catalyst is disclosed in, e.g., U.S. Pat. No. 5,326,926.

If a non-halided catalyst is utilized, the dryers 164 and 168 and the chloride stream 170 can be omitted. Particularly, the combined feed 124 can proceed directly to the isomerization reaction zone 180 without drying. In addition, the make-up gas stream 162 can also pass directly to the isomerization reaction zone 180 absent drying. Catalysts incorporated in such zones are disclosed in, e.g., U.S. Pat. No. 7,223,898 B2.

Another suitable isomerization catalyst is a solid strong acid catalyst, which may include a sulfated support of an oxide or hydroxide of a Group IVB (IUPAC 4) metal, preferably a zirconium oxide or hydroxide, at least a first component of a lanthanide element or yttrium, and at least a second component being a platinum-group metal component. The Group IVB (IUPAC 4) metal may include titanium, zirconium, halfnium, and dubnium. The catalyst optionally contains an inorganic-oxide binder, such as alumina.

The support material of the solid strong acid catalyst can include an oxide or a hydroxide of a Group IVB (IUPAC 4) metal. In one exemplary embodiment, the Group IVB element is zirconium or titanium. Sulfate may be composited on the support material. A component of a lanthanide-series element can be incorporated into the composite using any suitable means. The lanthanide-series element component may be one or more of lanthanum, cerium, praseodymium, neodymium, promethium, samarium, europium, gadolinium, terbium, dysprosium, holmium, erbium, thulium, ytterbium and lutetium. A suitable amount of the lanthanide series component may be about 0.01-about 10%, by weight, on an elemental basis, based on the weight of the catalyst. A platinum-group metal component may be added to the catalytic composite by any suitable means, such as impregnation. The platinum-group metal component may be one or more of platinum, palladium, ruthenium, rhodium, iridium, and osmium, in an amount of about 0.01-about 2%, by weight, of the platinum-group metal component, on an elemental basis based on the weight of the catalyst.

Optionally, the catalyst is bound with a refractory inorganic oxide. The binder, when employed, usually comprises from about 0.1-about 50%, preferably about 5-about 20%, by weight, based on the weight of the finished catalyst. The support, sulfate, metal components and optional binder may be composited in any order effective to prepare a catalyst useful for the isomerization of hydrocarbons. Examples of suitable atomic ratios of lanthanide or yttrium to platinum-group metal may be at least about 1:1; preferably about 2:1. Optionally, the catalyst may further include a third component of iron, cobalt, nickel, rhenium or a mixture thereof. As an example, iron may be present in an amount of about 0.1-about 5%, by weight, on an elemental basis based on the weight of the catalyst. In one exemplary embodiment, the solid strong acid isomerization catalyst may be sulfated zirconia or a modified sulfated zirconia.

The isomerization reaction zone 180 can operate at any suitable conditions depending on the composition of the combined feed 124 and catalyst type. As an example, operating conditions within the isomerization reaction zone 180 may be selected to maximize the production of isoalkanes. A temperature within the isomerization reaction zone 180 usually ranges from about 40-about 235° C. and a pressure usually ranges from about 700-7,000 kPa. The feed rate to the isomerization reaction zone 180 can also vary over a wide range, including a liquid hourly space velocity ranging from about 0.5-about 12 $hr^{-1}$.

The isomerization effluent 184 may be sent to the stabilizer zone 200 to separate the desired isomerized products from hydrogen, light ends, lower octane isomerized products, and cyclohexane plus heavy hydrocarbons having 7 or more carbon atoms. The stabilizer zone 200 can include a stabilizer column 220, a receiver 250 and a reboiler 224. The isomerization zone effluent 184 is provided to the stabilizer column 220 and produces a stabilizer overhead stream 240 and a bottom stream 226. Typically, the stabilizer column 220 can produce the stabilizer overhead stream 240 that may pass to the receiver 250, where one or more $C5^-$ hydrocarbons may separate as a gas stream 262 and be scrubbed for a halided isomerization catalyst or recycled for a non-halided isomerization catalyst. The stabilizer bottoms temperature may change significantly due to the presence of heavier hydrocarbons, such as $C7^+$ hydrocarbons, present in the feed, i.e., isomerization zone effluent 184 to the stabilizer column 220. A portion of the receiver bottom stream 254 can optionally be removed as a net product stream 264 with another portion provided as a reflux stream 258 to the stabilizer column 220.

Any suitable tray within the stabilizer column 220, typically within the top half, preferably two-fifths, or even top third, of the trays in the stabilizer column 220 can have a stripper feed 284 withdrawn as a side-stream from a tray 222. The stripper feed 284 can be provided to the stripper zone 300, and may include at least about 10%, by weight, one or more $C5^+$ hydrocarbons. Alternatively, the stripper feed 284 may include at least about 70%, or even about 85%, by weight, one or more $C5^+$ hydrocarbons.

In this manner, the following table discloses typical operating parameters for one exemplary embodiment having the stabilizer column 220 in conjunction with an isomerization reaction zone 180 containing a non-halided catalyst:

TABLE 2

| Parameter | General | Preferred | Optimal |
|---|---|---|---|
| Operating Pressure (kPa) | 790-2,100 | 1,100-1,500 | 1,200-1,420 |
| Bottoms Temperature (° C.) | 140-210 | 170-200 | Not Applicable |
| Stabilizer Trays | 25-75 | 35-60 | 40-50 |
| Stabilizer Reflux/Feed Molar Ratio | 0.5-3 | 1.0-2.5 | 1.5-2.0 |

A bottom stream 226 from the stabilizer column 220 can be split into a reboiling stream 228 and a net bottom or product stream 234. The reboiling stream 228 can pass through the reboiler 224 and be heated with any suitable heating stream 232, such as a pressurized steam or a process stream. Typically, the bottom stream 226 can include at least about 85%, by weight, one or more $C6^+$ hydrocarbons. The product stream 234 can be combined with a net overhead stream 432 from the C5 splitter zone 400, as hereinafter described, to form a combined isomerate product stream 440 for, e.g., a gasoline blending pool. Typically, the isomerate product stream 440 is rich in C5 isomers.

The stripping zone 300 can include a stripper column 304 having a reboiler 316 that can provide a stripper overhead stream 308 and a stripper bottom stream 312. Generally, the purpose of the stripper column 304 is to strip $C4^-$ hydrocarbons to provide a net stripper bottom stream 330 containing predominantly C5 one or more hydrocarbons to be sent to the C5 splitter zone 400. Generally, the stripper overhead stream 308 includes at least about 5%, by weight, one or more $C4^-$ hydrocarbons. The stripper bottom stream 312 can be split into a stripper reboiling stream 320 and the net stripper bottom stream 330 and include at least about 90%, by weight, one or more $C5^+$ hydrocarbons. The heating stream 322 can use any suitable heat source, such as another process stream or pressurized steam. The stripper reboiling stream 320 can be returned to the stripper column 304. As depicted, the stripper column 304 typically includes the reboiler 316, but may not include a condenser and a receiver.

Typically, the stripper column 304 is operated to provide the net stripper bottom stream 330 that has low levels of $C4^-$ hydrocarbons, which can be provided to the C5 splitter zone 400, as hereinafter described. In this manner, the following table discloses typical operating parameters for one exemplary embodiment having the stripper column 304 in conjunction with an isomerization reaction zone 180:

TABLE 3

| Parameter | General | Preferred |
|---|---|---|
| Bottoms Temperature (° C.) | 115-160 | 130-145 |
| Stripper Column Trays | 5-30 | 10-20 |

In this exemplary embodiment, withdrawing the side-stream can allow the separation of C5 hydrocarbons for recycling to the isomerization reaction zone 180. Moreover, sending the net stripper bottom stream 330 to the C5 splitter zone 400 can remove isopentane.

The net stripper bottom stream 330 may be provided to the C5 splitter zone 400, which can contain a C5 splitter column 410 and a receiver 420 for splitting isopentane and pentane. Generally, isopentane may exit in an overhead stream 414 and pass to the receiver 420. A receiver bottom stream 424 can be split into a reflux stream 428 returned to the C5 splitter column 410 and a net overhead stream 432. The net overhead stream 432 can be combined with the stabilizer net bottom stream 234 to form the isomerate product stream 440. Generally, the net overhead stream 432 can be rich in one or more C5 isomers, and may contain at least about 50%, preferably about 90%, by mole, isopentane. The bottom stream 324 from the C5 splitter column containing normal pentane can be recycled to the feed stream 120 to form the combined feed 124 for the isomerization reaction zone 180. Although not depicted in the drawings, all columns depicted may be associated with other equipment, such as reboilers, condensers, and heat exchangers.

Exemplary compositions for streams in the isomerate manufacturing zone 100 as depicted in FIG. 1 without the net product stream 264 can be as follows:

TABLE 4

(in percent, by weight, based on weight of the stream)

| Stream | Range | C4⁻ | Total C5 | iC5 | nC5 | C6 | C7⁺ |
|---|---|---|---|---|---|---|---|
| 432 | General | 0-5 | — | 85-99.5 | 0.1-15 | <0.1 | <0.1 |
| | Typical | 1-2 | — | 90-95 | 2-5 | <0.1 | <0.1 |
| 124 | General | <0.1 | — | 1-30 | 10-80 | 10-95 | 0-15 |
| | Typical | <0.1 | — | 5-15 | 30-60 | 40-70 | 2-5 |
| 262 | General | 80-98 | 2-20 | — | — | — | — |
| | Typical | 90-95 | 5-10 | — | — | — | — |
| 284 | General | 1-15 | — | 60-80 | 10-30 | 1-15 | <0.1 |
| | Typical | 3-9 | — | 65-75 | 16-22 | 2-7 | <0.1 |
| 324 | General | 0-2 | — | 10-50 | 30-80 | 5-25 | <0.1 |
| | Typical | <0.1 | — | 15-40 | 40-65 | 10-20 | <0.1 |
| 234 | General | <0.1 | 0-10 | — | — | 80-95 | 1-10 |
| | Typical | <0.1 | 0-5 | — | — | 92-94 | 2-5 |

Exemplary compositions for streams in isomerate manufacturing zone 100 as depicted in FIG. 1 with the net product stream 264 can be as follows:

TABLE 5

(in percent, by weight, based on weight of the stream)

| Stream | Range | C4⁻ | Total C5 | iC5 | nC5 | C6 | C7⁺ |
|---|---|---|---|---|---|---|---|
| 432 | General | 0-5 | — | 85-99.5 | 0.1-15 | <0.1 | <0.1 |
| | Typical | 1-2 | — | 90-95 | 2-5 | <0.1 | <0.1 |
| 124 | General | <0.1 | — | 1-30 | 10-80 | 10-95 | 0-15 |
| | Typical | <0.1 | — | 5-15 | 30-60 | 40-70 | 2-5 |
| 262 | General | 95-100 | 0-5 | — | — | — | — |
| | Typical | 98-99.5 | 0-2 | — | — | — | — |
| 284 | General | 1-15 | — | 60-80 | 10-30 | 1-15 | <0.1 |
| | Typical | 3-8 | — | 68-78 | 15-25 | 2-7 | <0.1 |
| 324 | General | 0-2 | — | 10-50 | 30-80 | 5-25 | <0.1 |
| | Typical | <0.1 | — | 20-40 | 40-60 | 10-20 | <0.1 |
| 234 | General | <0.1 | 0-15 | — | — | 80-95 | 1-10 |
| | Typical | <0.1 | 2-8 | — | — | 90-94 | 2-5 |
| 264 | General | 90-100 | 0-10 | — | — | <0.1 | <0.1 |
| | Typical | 97-99 | 1-3 | — | — | <0.1 | <0.1 |

In this exemplary embodiment with a non-halided catalyst, there is typically no need to remove halide compounds such as hydrogen chloride. As a result, the net product stream 264 may be taken as a product.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for isomerizing a feed stream comprising one or more C4-C6 paraffins, comprising:

A) contacting the feed stream in an isomerization reaction zone with an isomerization catalyst at isomerization conditions to produce an isomerization zone effluent;

B) passing at least a portion of the isomerization zone effluent to a stabilizer zone and recovering a stabilizer overhead stream comprising one or more C5⁻hydrocarbons, a bottom stream comprising at least about 85%, by weight, one or more C6⁺hydrocarbons, and a side-stream comprising at least about 85%, by weight, one or more C5⁺ hydrocarbons;

C) passing at least a portion of the side-stream to a stripper zone; and

D) sending a stripper bottom stream comprising at least about 90%, by weight, one or more $C_5^+$ hydrocarbons to a $C_5$ splitter zone comprising a $C_5$ splitter column to produce a $C_5$ splitter column overhead stream and a $C_5$ splitter column bottom stream; and E) passing the $C_5$ splitter column bottom stream to the isomerization reaction zone.

2. The process according to claim 1, wherein the stripper zone comprises a stripper column, wherein the stripper bottom stream upon exiting the stripper column is at a temperature of about 115-about 160° C.

3. The process according to claim 2, wherein a stripper feed stream is withdrawn from a tray at a top half of a stabilizer column.

4. The process according to claim 1, wherein the $C_5$ splitter column overhead stream comprises at least about 85%, by weight, one or more $C_5$ hydrocarbons.

5. The process according to claim 4, wherein the C5 splitter column overhead stream comprises at least about 50%, by mole, isopentane.

6. The process according to claim 1, wherein the isomerization reaction zone comprises a catalyst, in turn, comprising a support comprising a sulfated oxide or hydroxide of at least one element of titanium, zirconium, halfnium, and dubnium; a first component of at least one element of a lanthanide series and yttrium; and a second component of at least one element of platinum, palladium, ruthenium, rhodium, iridium, and osmium.

7. The process according to claim 1, wherein the isomerization reaction zone comprises a catalyst, in turn, comprising an alumina, a platinum, and a chloride.

8. The process according to claim 1, wherein the stabilizer zone comprises a stabilizer column, and the bottom stream exiting the stabilizer column is at a temperature of about 140-about 210° C.

9. The process according to claim 8, wherein the stabilizer column operates at a pressure of about 790-about 2,100 kPa.

10. The process according to claim 1, further comprising drying a make-up gas to the isomerization reaction zone.

11. The process according to claim 1, further comprising drying a feed to the isomerization reaction zone.

12. The process according to claim 1, further comprising providing a chloride stream to the isomerization reaction zone.

13. The process according to claim 1, wherein the stream sent from the C5 splitter zone to the isomerization reaction zone is a bottom stream.

14. The process according to claim 1, further comprising combining the stabilizer bottom stream with an overhead stream from the C5 splitter and forming an isomerate product stream.

15. A process for isomerizing a feed stream comprising one or more C4-C6 parrafins, comprising:

A) contacting the feed stream in an isomerization reaction zone with an isomerization catalyst at isomerization conditions to produce an isomerization zone effluent;

B) passing at least a portion of the isomerization zone effluent to a stabilizer column and recovering a stabilizer overhead stream comprising one or more $C5^-$hydrocarbons, a bottom stream comprising at least about 85%, by weight, one or more $C6^+$ hydrocarbons, and a side-stream comprising at least about 85%, by weight, one or more $C5^+$ hydrocarbons;

C) passing at least a portion of the side-stream to a stripper column;

D) sending a stripper bottom stream comprising at least about 90%, by weight, one or more $C5^+$ hydrocarbons to a C5 splitter column to obtain an overhead stream and a bottom stream; and E) combining the C5 splitter column overhead stream with the stabilizer bottom stream as an isomerate product stream and recycling the C5 splitter column bottom stream to the isomerization reaction zone.

16. The process according to claim 15, wherein the stripper bottom stream upon exiting the stripper column is at a temperature of about 115-about 160° C.

17. The process according to claim 15, wherein the side-stream is withdrawn from a tray at a top half of the stabilizer column.

18. The process according to claim 15, wherein the bottom stream exiting the stabilizer column is at a temperature of about 140-about 210° C.

19. The process according to claim 15, wherein the stabilizer column operates at a pressure of about 790-about 2,100 kPa.

* * * * *